US006257532B1

(12) United States Patent
Ives

(10) Patent No.: US 6,257,532 B1
(45) Date of Patent: Jul. 10, 2001

(54) DOLL STAND

(76) Inventor: Betty Jean Ives, 109 S. Fork Rd., Cheyenne, WY (US) 82007-9794

( * ) Notice: Subject to any disclaimer, the term of this patent is extended or adjusted under 35 U.S.C. 154(b) by 0 days.

(21) Appl. No.: 09/538,219

(22) Filed: Mar. 30, 2000

(51) Int. Cl.[7] ..... F16M 13/00

(52) U.S. Cl. ..... 248/158; D21/658; 248/121; 248/146

(58) Field of Search ..... 248/127, 146, 248/158, 176.1, 121; 446/268; D21/658; D6/449; 211/13

(56) References Cited

U.S. PATENT DOCUMENTS

| | | | | |
|---|---|---|---|---|
| 180,613 | | 8/1876 | McCutchins | 446/268 |
| D. 305,920 | * | 2/1990 | Butler | D21/658 |
| D. 363,959 | * | 11/1995 | Grubbs | D21/658 |
| 1,661,805 | * | 3/1928 | Lentaty | 248/127 |
| 2,455,278 | * | 11/1948 | Stewart et al. | 248/154 |
| 2,527,152 | * | 10/1950 | Ransom et al. | 248/158 |
| 3,244,389 | * | 4/1966 | Wilkins | 248/158 |
| 3,512,741 | | 5/1970 | Goldstein | 248/206.5 |
| 3,516,632 | | 6/1970 | Hall | 248/176.1 |
| 4,359,786 | * | 11/1982 | Rosberg et al. | 4/144.1 |
| 4,367,695 | * | 1/1983 | Lance | 119/485 |
| 4,573,682 | * | 3/1986 | Mayon | 273/148 B |
| 4,706,915 | * | 11/1987 | Cindric et al. | 248/125.8 |
| 4,845,859 | * | 7/1989 | Evans | 34/107 |
| 4,889,246 | * | 12/1989 | Lee | 211/163 |
| 5,549,499 | | 8/1996 | Foskey et al. | 446/268 |
| 5,873,522 | * | 2/1999 | Roberts | 239/1 |

* cited by examiner

*Primary Examiner*—Ramon O. Ramirez
*Assistant Examiner*—Jon A Szumny
(74) *Attorney, Agent, or Firm*—Patent & Trademark Services; Joseph H. McGlynn

(57) ABSTRACT

A doll stand which has a base and a vertical support pole attached thereto. At the top of the vertical support pole is a U-shaped saddle, into which the doll fits with one leg on each side of the saddle.

14 Claims, 3 Drawing Sheets

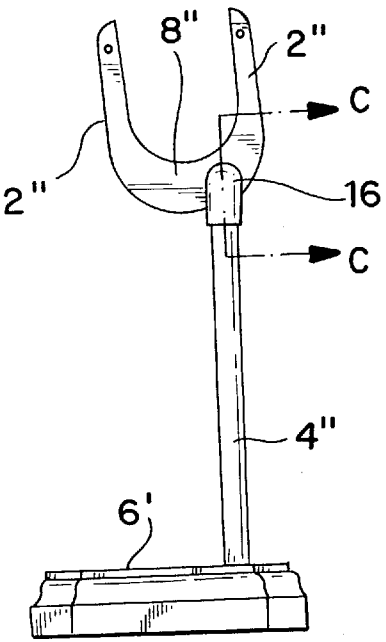
FIG. 9
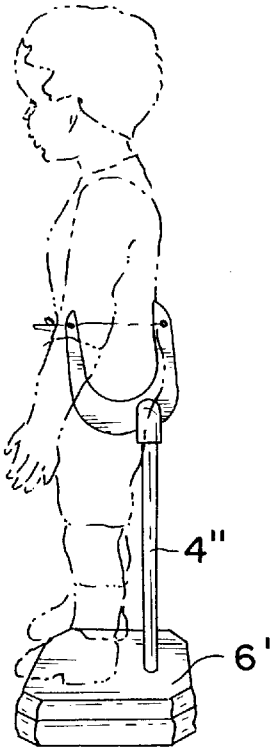
FIG. 8
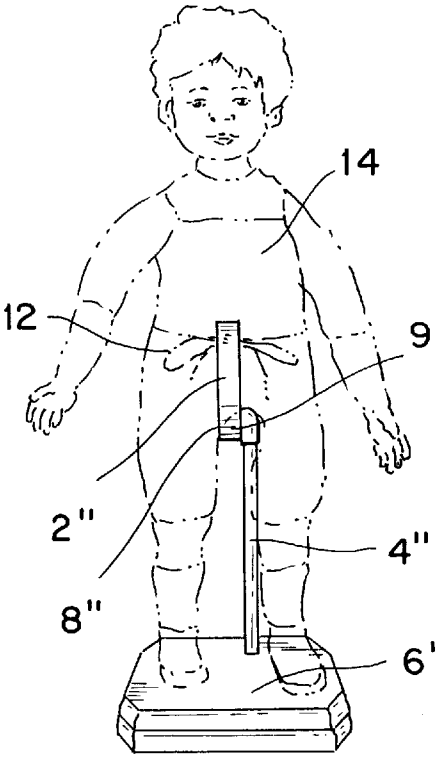
FIG. 7
FIG. 5
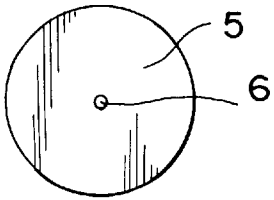
FIG. 6
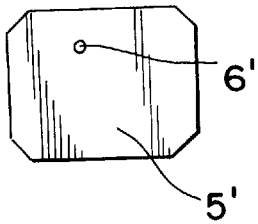

FIG. 10
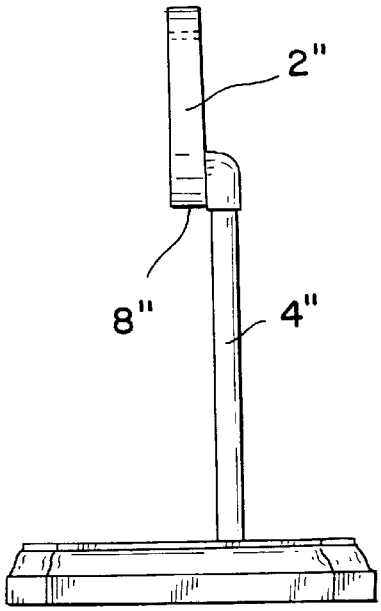
FIG. 11
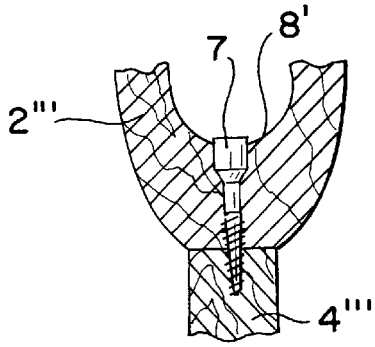
FIG. 12
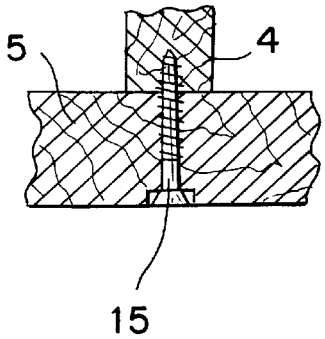
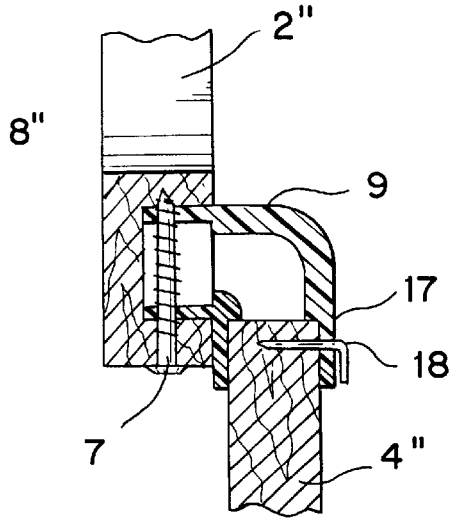
FIG. 13

DOLL STAND

BACKGROUND OF THE INVENTION

This invention relates, in general, to stands, and, in particular, to stands for supporting dolls in a standing position.

Description of the Prior Art

In the prior art various types of doll stands have been proposed. For example, the patent to McCutchine discloses a doll stand having three support legs and ties which can be fastened around the doll's body.

The patent to Goldstein discloses a doll support which has a support which can be fastened to a vertical surface and which has a ring which can be fastened to either the doll's waist or leg.

The patent to Hall discloses a a doll stand which has a base, a vertical support and a pair of rings which engage around the doll's legs.

The patent to Foskey et al discloses a doll stand with a base, a two part vertical support which can be adjusted to support different height dolls, and a support loop that can be fitted to a doll's waist.

SUMMARY OF THE INVENTION

The present invention is directed to a doll stand which has a base and a vertical support pole attached thereto. At the top of the vertical support pole is a U-shaped saddle, into which the doll fits with one leg on each side of the saddle.

It is an object of the present invention to provide a new and improved doll stand.

It is an object of the present invention to provide a new and improved doll stand which will fit and support any size doll in a stable manner.

It is an object of the present invention to provide a new and improved doll stand which will provide a more stable support for a standing doll.

These and other objects and advantages of the present invention will be fully apparent from the following description, when taken in connection with the annexed drawings.

BRIEF DESCRIPTION OF THE DRAWINGS

FIG. 5 is a top view of a base used with the present invention.

FIG. 6 is a top view of another base used with the present invention.

FIG. 7 is a front view showing a male doll mounted on the present invention.

FIG. 8 is a side view showing a male doll mounted on the present invention.

FIG. 9 is a side view of another embodiment of the present invention.

FIG. 10 is a front view of the embodiment of FIG. 9.

FIG. 11 is sectional view taken along section lines AA of FIG. 2.

FIG. 12 is sectional view taken along section lines BB of FIG. 2.

FIG. 13 is sectional view taken along section lines CC of FIG. 9.

DESCRIPTION OF THE PREFERRED EMBODIMENT

Figure 1:
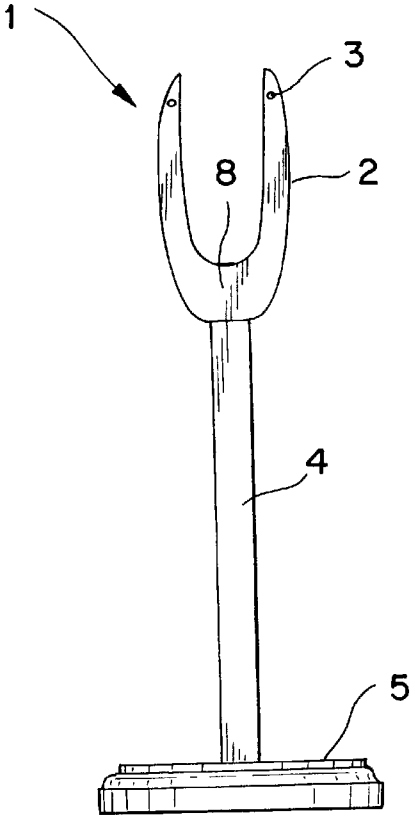
FIG. 1 is a side view of the present invention.

Referring now to the drawings in greater detail, FIG. 1 shows a doll stand 1. The stand has a base 5 with an aperture 6 therein which will receive a vertical support pole 4. The vertical support pole 4 can be attached within the aperture 6 (see FIG. 5) in any conventional manner. In the alternative, the pole 4 and the base 6 could be made as a single unitary piece.

Figure 3:
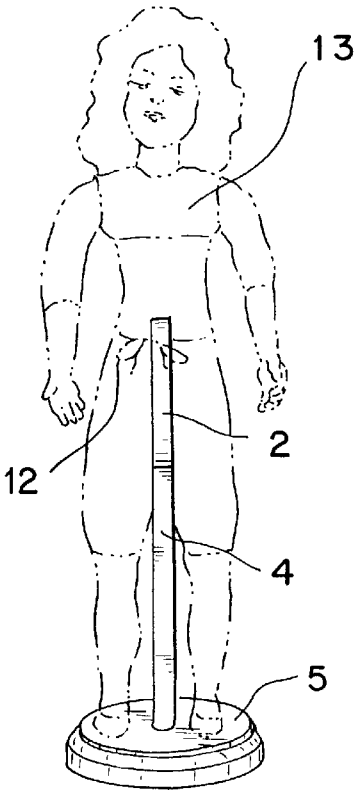
FIG. 3 is a front view showing a female doll mounted on the present invention.
Figure 2:
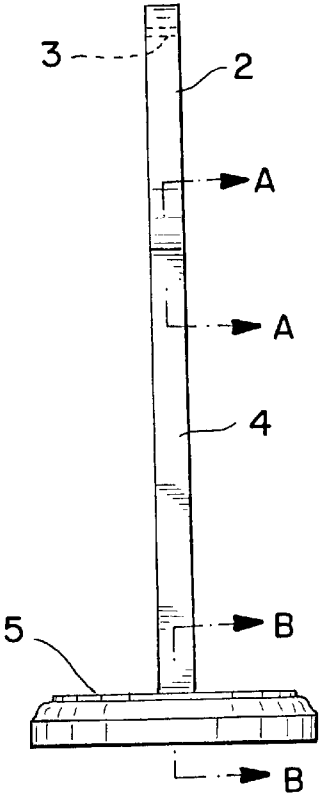
FIG. 2 is a front view of the present invention.

Attached to the top of the vertical support pole 4 is a saddle. The saddle, as shown in FIG. 1, is U-shaped and has a pair of arms 2 and a saddle base 8. The saddle base 8 is attached to the vertical support pole 4 in any conventional manner such as, but not limited to, gluing. Each of the arms 2 has an aperture 3 extending therethrough so a tie 12 (see FIGS. 3 and 7) can be passed through the aperture in order to tie the doll to the stand. This will provide a more stable support for the doll 13, shown in FIG. 3, which is critical if the doll, or parts thereof, are made from a fragile material such as porcelain.

Figure 4:
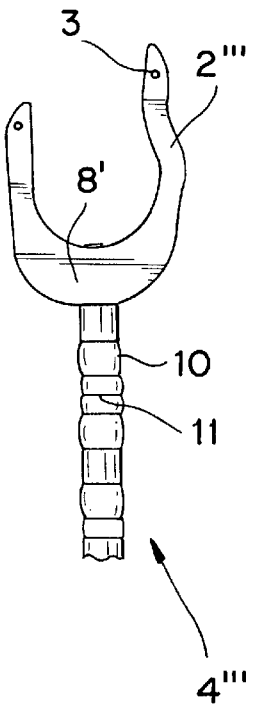
FIG. 4 is a side view of another saddle and support pole used with the present invention.

It should be noted that the length of the arms 2, 2', 2''', as shown in FIGS. 1, 9, 4 may vary with one arm being longer or shorter than the other arm. This is to provide more or less support depending on the size of the doll and the materials that the upper portion of the doll is made from. For example if the upper portion of the doll is made from porcelain it would be heavier, which would make the doll top heavy. In order to compensate for this one of the arms could be made longer to provide more support, as shown in FIG. 4.

In addition, it should be noted that the length of the vertical support pole 4 could be varied depending on the size of the doll to be supported by the stand 1.

FIG. 6 shows another embodiment 5' of the stand base which has an octagon shape, whereas the base 5 shown in FIG. 1 has a circular shape. The shape of the base can be critical depending on the size of the doll and the type of clothes worn by the doll. The shape shown in FIG. 6 would be more stable if a taller doll were supported by the stand since the length of the base could be increased to compensate for the height of the doll and the increased upper weight of the doll. Also, if the doll is clothed with a short dress that does not hide the base of the stand, a base as in FIG. 6 would be more esthetically pleasing.

FIG. 4 shows a modification of the doll stand which has a vertical support pole 4''' which is attached to the saddle having arms 2''' and a saddle base 8'. in the FIG. 4 device, a screw 7 is passed through the saddle base 8' (see FIG. 11) and into the top of the vertical support pole 4''' in order to fasten the saddle to the vertical support pole 4'''. A series of enlargements 10 and reduced sections 11 make up the vertical support pole 4''' to make the pole more esthetically pleasing. The saddle could be attached to the pole 4''' in any conventional manner including the attachments shown in FIG. 11.

FIGS. 9, 10 and 13 show another modification of the doll stand which attaches the arms 2" saddle 8" to a vertical support pole 4". In this case, a horizontal section 9 is added to the top of the vertical support pole 4". This horizontal section 9 will fit into an aperture on the saddle base 8" in order to attach the saddle to the vertical support pole 4". The horizontal section 9 can secured in the saddle base 8" in any conventional manner such as, but not limited to, a friction fit. In the alternative, a screw 17 can be driven through the bottom of the saddle 8" and through the horizontal section 9 to secure the horizontal section 9 to the saddle 8". In order to secure the vertical portion 17 to the pole 4", an L-shaped pin can be passed through apertures in the vertical portion 17 and the pole 4", as shown in FIG. 13.

FIG. 9 shows another modification of the vertical support pole 4" which supports a saddle 2". In this case this stand will be used to support a doll which is wearing pants, such as the doll 14 shown in FIGS. 7 and 8. It should be noted that the pants are not shown in FIGS. 7 and 8 for clarity. In this case, since the dolls clothes (usually the female doll's dress) can not hide the vertical support pole 4", the arms and the saddle are offset from the pole 4" so the pole can be positioned behind the doll 14 and one of the arms 2" can be inserted into one of the pants leg of the doll.

In order to use the doll stand of the present invention, a doll would be placed into the saddle, for example the saddle shown in FIG. 1, with one of the arms 2 in front of the doll and the other arm 2 placed behind the doll. This will provide support for the doll from the front as well as from the back, and make it harder for the doll to tip over toward the front or the back since the arms 2 will provide support in both directions. If the doll is clothed in a dress, the dress would be pulled up before the doll is placed in the saddle, and then pulled down after positioning the doll to hide, or at least partially hide, the saddle and vertical support pole 4.

In addition, if the doll is particularly top heavy, a tie 12 could be passed through one or both of the apertures 3 and then tied around a portion of the doll to further secure the doll to the stand. Also, the tie 13 will secure the doll if it is being moved. A user could also carry the doll by the arms, sit down and it won't fall off the stand and break. In addition, if the doll is shipped it will not move around if tied to the stand.

Although the Doll Stand and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A doll stand adapted to support a doll in an upright position, said doll stand comprising:

a base, a vertical support attached to said base and extending upwardly therefrom, a saddle attached adjacent a top of said vertical support, said saddle comprising a pair of arms attached to a saddle base, and said saddle base is attached to said vertical support, and wherein wherein said saddle base has an aperture extending horizontally therethrough, and said vertical support has a horizontal section extending therefrom, and said horizontal section on said vertical support extends into said horizontally extending aperture in said saddle base in order to secure said saddle to said vertical support, and wherein said horizontal section has a vertical section extending therefrom, and said vertical section receives said vertical support.

2. The doll stand as claimed in claim 1, wherein at least one of said pair of arms has an aperture extending therethrough.

3. The doll stand as claimed in claim 2, wherein a tie means extends through said aperture for securing a doll to said doll stand.

4. The doll stand as claimed in claim 1, wherein one of said pair of arms is longer than another of said pair of arms.

5. The doll stand as claimed in claim 1, wherein said base is circular.

6. The doll stand as claimed in claim 1, wherein said base is octagonal.

7. The doll stand as claimed in claim 1, wherein said saddle base is attached to said vertical support by a screw, said screw extends through said saddle base and into said vertical support.

8. The doll stand as claimed in claim 1, wherein said horizontal section on said vertical support is secured in said horizontally extending aperture by a friction fit.

9. The doll stand as claimed in claim 1, wherein said doll stand has a means for fastening said saddle base to said vertical support, said means extending through said horizontal section into said saddle base.

10. The doll stand as claimed in claim 9, wherein said means is a threaded fastener.

11. The doll stand as claimed in claim 1, wherein a fastener extends through said vertical section and into at least a portion of said vertical support for securing said vertical section to said vertical support.

12. The doll stand as claimed in claim 11, wherein said fastener extends through said vertical section and through said vertical support.

13. The doll stand as claimed in claim 1, wherein said vertical support has a plurality of enlarged sections and a plurality of reduced sections extending along said vertical support, and said enlarged sections and said reduced sections are positioned alternately along said vertical support.

14. A doll stand adapted to support a doll in an upright position, said doll stand comprising:

a base, a vertical support attached to said base and extending upwardly therefrom, a saddle attached adjacent a top of said vertical support, said saddle comprising a pair of arms attached to a saddle base, and said saddle base is attached to said vertical support, and wherein wherein said saddle base has an aperture extending horizontally therethrough, and said vertical support has a horizontal section extending therefrom, and said horizontal section on said vertical support extends into said horizontally extending aperture in said saddle base in order to secure said saddle to said vertical support, and wherein said doll stand has a means for fastening said saddle base to said vertical support, said means extending through said horizontal section into said saddle base, and wherein said means is a threaded fastener, and wherein said threaded fastener extends through a portion of said saddle base, through said horizontal section, and into another portion of said saddle base.

* * * * *